US010326229B2

(12) United States Patent
Goggin

(10) Patent No.: US 10,326,229 B2
(45) Date of Patent: Jun. 18, 2019

(54) TERMINATION IDENTIFICATION DEVICE AND SYSTEM

(71) Applicant: KNXID, LLC, Henderson, NV (US)

(72) Inventor: Matthew Goggin, Waipahu, HI (US)

(73) Assignee: KNXID, LLC, Beverly, MA (US)

( * ) Notice: Subject to any disclaimer, the term of this patent is extended or adjusted under 35 U.S.C. 154(b) by 0 days.

(21) Appl. No.: 14/214,214

(22) Filed: Mar. 14, 2014

(65) Prior Publication Data

US 2014/0273611 A1 Sep. 18, 2014

Related U.S. Application Data

(60) Provisional application No. 61/786,466, filed on Mar. 15, 2013.

(51) Int. Cl.
*H01R 13/46* (2006.01)
*H01R 13/52* (2006.01)
*H01R 24/64* (2011.01)

(52) U.S. Cl.
CPC ..... *H01R 13/465* (2013.01); *H01R 13/5213* (2013.01); *H01R 24/64* (2013.01); *Y10T 29/49174* (2015.01)

(58) Field of Classification Search
CPC ... H01R 13/465; H01R 13/5213; H01R 24/64
USPC ..... 439/491
See application file for complete search history.

(56) References Cited

U.S. PATENT DOCUMENTS

D296,548 S * 7/1988 Laurie ..... D13/156
D316,399 S * 4/1991 Wharton ..... D13/133
5,334,044 A * 8/1994 Falossi ..... H01R 13/465 439/447
5,462,457 A * 10/1995 Schroepfer ..... H01R 13/5845 439/344
5,494,457 A 2/1996 Kunz
5,529,513 A 6/1996 Lee
5,538,438 A * 7/1996 Orlando ..... H01R 13/506 439/344
5,620,335 A * 4/1997 Siemon ..... H01R 13/46 439/447
5,647,043 A * 7/1997 Anderson ..... G02B 6/3825 385/78
5,685,731 A 11/1997 Lin
5,923,805 A * 7/1999 Anderson ..... G02B 6/3825 385/139
6,146,207 A * 11/2000 Mulot ..... H01R 13/64 439/344

(Continued)

FOREIGN PATENT DOCUMENTS

GB 2 398 435 8/2004

*Primary Examiner* — Alexander Gilman
(74) *Attorney, Agent, or Firm* — Holland & Hart LLP

(57) ABSTRACT

A device, method, and a system for identifying a connection cable from a communication device or facilities. The device comprises a connector for attaching to an end of a connection cable, said device bearing connection cable-identification means, such as alpha-numeric markings. In the embodiments described herein, the device comprises a shape for securely but releasably attaching to the connection cable end while the system comprises communication facilities that employ such devices. The device, method, and system described herein may have particular application for a connection cable having an end that is not connected with a communication device.

22 Claims, 3 Drawing Sheets

(56) References Cited

U.S. PATENT DOCUMENTS 6,227,717 B1 * 5/2001 Ott ..... G02B 6/3849 385/134
6,520,796 B1 * 2/2003 Reichle ..... H01R 13/465 439/491
6,718,674 B2 * 4/2004 Caveney ..... G09F 3/20 40/611.09
7,014,495 B2 * 3/2006 Carroll ..... H01R 13/582 439/404
7,014,500 B2 * 3/2006 Belesimo ..... H01R 13/6691 439/489
7,049,937 B1 * 5/2006 Zweig ..... H01R 13/641 324/66
7,101,212 B1 * 9/2006 Larkin ..... H01R 24/64 439/344
7,160,156 B2 1/2007 Holliday
7,163,414 B2 * 1/2007 Lo ..... H01R 13/562 439/352
7,182,628 B2 2/2007 Holliday
7,193,422 B2 * 3/2007 Velleca ..... H01R 13/6691 324/538
7,207,724 B2 * 4/2007 Gurreri ..... 385/58
7,249,979 B2 7/2007 Gerber et al.
7,340,146 B2 * 3/2008 Lampert ..... G02B 6/3849 385/134
7,367,832 B2 5/2008 Muhs et al.
7,410,377 B2 * 8/2008 Wharton ..... H01R 13/633 439/172
7,431,604 B2 * 10/2008 Waters ..... H01R 13/582 439/344
7,435,126 B1 * 10/2008 Larkin ..... H01R 13/6272 439/352
7,540,667 B2 * 6/2009 Murano ..... G02B 6/3879 385/59
7,594,829 B2 * 9/2009 Vaden ..... H01R 24/64 439/676
7,708,581 B2 * 5/2010 Weiss ..... H01R 13/6275 439/344
7,753,711 B2 7/2010 Chen et al.
7,806,721 B2 * 10/2010 Herndon ..... H01R 13/518 439/540.1
7,892,012 B1 * 2/2011 Foung ..... H01R 13/6272 439/344
8,033,873 B2 * 10/2011 Ankerstjerne ..... H01R 13/465 379/22.03
8,038,456 B1 * 10/2011 Wang ..... G02B 6/3893 385/56
8,038,460 B2 * 10/2011 Andres ..... G02B 6/389 439/344
8,142,223 B2 3/2012 Holliday
8,215,972 B2 * 7/2012 Wang ..... G02B 6/3897 385/56
8,235,731 B1 * 8/2012 Poulsen ..... H01R 13/6466 439/676
D675,166 S * 1/2013 Hopper ..... D13/156
8,485,834 B2 * 7/2013 Bodette ..... H01R 13/443 439/88
8,540,435 B2 * 9/2013 Norris ..... G02B 6/3865 385/53
8,936,194 B1 * 1/2015 Welch ..... G06K 7/1417 235/435
9,130,318 B2 * 9/2015 Standish ..... G06K 7/10415
9,461,397 B2 * 10/2016 Feldmeier ..... H01R 13/5216
9,531,126 B2 * 12/2016 Krietzman ..... H01R 13/639
9,823,425 B2 * 11/2017 Xiao ..... G02B 6/3849
2006/0094291 A1 * 5/2006 Caveney ..... H01R 13/641 439/540.1
2006/0148279 A1 * 7/2006 German ..... H01R 13/465 439/49
2009/0142950 A1 * 6/2009 Schimmele-Brell ..... H01R 13/523 439/271
2010/0015847 A1 * 1/2010 Jacks ..... H01R 13/641 439/490
2010/0210142 A1 * 8/2010 McGrath ..... H01R 12/594 439/620.22
2010/0271182 A1 * 10/2010 Yashukova ..... G01R 31/043 340/10.1
2010/0289412 A1 11/2010 Middleton-White et al.
2013/0260582 A1 * 10/2013 White ..... H01R 13/453 439/149
2014/0126875 A1 * 5/2014 Guzzo ..... G02B 6/3825 385/139
2014/0273611 A1 * 9/2014 Goggin ..... H01R 13/465 439/491
2015/0099379 A1 * 4/2015 Borden ..... H01R 13/44 439/133

* cited by examiner

TERMINATION IDENTIFICATION DEVICE AND SYSTEM

CROSS-REFERENCE TO RELATED APPLICATIONS

This U.S. Non-Provisional Utility patent application claims the benefit, under 35 U.S.C. § 119, of U.S. Provisional Patent Application No. 61/786,466 filed Mar. 15, 2013, the contents of which are incorporated herein by this reference in their entireties.

FIELD OF INVENTION

The present invention is in the technical field of information technology. More particularly, the present invention relates to connection identification.

BACKGROUND OF INVENTION AND DESCRIPTION OF PRIOR ART

With the modern era's explosion of information technology, there is an increasing need for improved systems and devices to identify an inventory of connections. Whether in the setting of a business, home, or other, multiple devices may require connection. For example, a server may comprise multiple connections, such as, in particular, connections for communicating on a network. Similarly, a work station may require a connection to a network device in order to access the server; for example, an Ethernet television (ETV) may require connections to channels in an ETV server. Since technology and related standards may change over time in unpredictable and sometimes rapid ways, it is anticipated that some novel principles relating to improved systems and devices may have application for such advancements while still being immediate useful and compatible with existing network termination standards.

For example, a popular current networking standard ETHERNET uses both copper and fiber mediums to establish communication connections. The termination points (or connections) for these are standard across the industry. In typical current constructs, infrastructure and cabling are aggregated into communication facilities (whether for low or high density applications). Oftentimes the infrastructure itself is terminated into patch panels, which allow for final completion of the physical links into the communication equipment, sometimes referred to as "nodes" (such as computers, telephones, etc.), which may be located near or far from the patch panels. More specifically, physical links connecting the communications equipment and the patch panels are often connection cables. Generally, in order to establish a connection, the connection cables are first connected to the patch panel and from the patch panel the opposite end of the connection cable (sometimes known as the tail end) may connect to a particular communication device (e.g, router, switch, Ethernet TV ("ETV") server, sound system), thus completing an end-to-end connection.

One problem with currently available systems and devices for network identification and inventory is that most do not allow for a correlation between patch panels and communication devices. Rather, such prior art systems and devices tend to rely heavily on a highly manual process sometimes called "tracing." Some tracing processes consist of one information technology professional starting on one end or portion of a cable or connection and then tracing the cable by touch or by sight all the way back to an end point. This usually time-consuming process generally only allows one connection to be actively traced at a time, which process must be repeated for multiple if not all of the connections.

Those systems, methods, and devices for network identification and inventory that do attempt to alleviate the problems associated with tracing, by allowing for a correlation between patch panels and communication devices, mostly do so through the utilization of male connectors. In other words, said systems, methods, and devices utilize either the connection cables themselves or the ends of the connection cable that basically comprise one uniform piece with (or at not least are not easily detachable from) the connection cable itself. Producing many different male connectors and/or cables according to varying color codes, alphanumeric markings, etc., can be costly to produce and somewhat inefficient, as already-labeled male-side cables are likely limited to the purpose for which they are labeled. For example, if a standard cable labeled "22" needed to be replaced or reused, another entire standard cable labeled "22" would essentially be required.

Another problem associated with prior art systems and devices is that, while labels or similar writings may be attached to the "male" connector or cables, such labels are generally not reusable, and may fall off during the tracing process. Moreover, having to repeatedly label each new connection cable and/or male connector takes time and effort, may be wasteful, and may impose ongoing costs. By way example, creating temporary labels (yellow "stickies," tape, or writing directly on the cable) for each connection cable with a disconnected end may not practical when multiple or many connections cables are removed for servicing or replacing a communication device, and relying purely on memory in such situations may be prone to error, if feasible at all.

SUMMARY OF THE INVENTION

In some operations and servicing any portion of a link (whether it be cabling, connection cable, communication device, etc.), the ability to quickly identify which connection cable is connected to which communication device or patch panel port is desirable. However, one encountered problem is not having a method or device for identifying the connections from the patch panels to the communication devices once an end of a connection cable is disconnected from a communication device/node. While modular communication devices may permit removal of a module without removal of connection cables, these normally require a certain amount of slack in the connection cables and risk damaging the connection cables. An effective method correlating connections would fill a need in an industry like IT.

The system, method, and device for network identification and inventory purposes described herein may utilize a female connector attachable to a male connector end of a cable connection, to assist in identifying the cable connection. Such a female connector may comprise connection cable identification means, which in some instances may comprise visible distinguishing characteristics such as, but not limited to, physical markings such as alphanumeric, symbols and/or color coding. Having such connection cable identification means on a female connector, side, or end, presents various advantages including but not limited to, lower costs, greater convenience, reusability, and allowing greater efficiency and speed when setting up the connection cables of a communication facility (whether such a facility comprises one connection cable or many).

Different communication facilities might utilize different labeling methods at the communication facilities, identifying the aggregation points to the end nodes. The connection ports, however, maintain standard identification usually in numerical increments, generally similar on all devices. Being able to identify a connection port to device, for example, by alphanumeric symbol and/or color, allows for improvements in both single use and also high density action. Moreover, reusable devices not specific to one communication facility are in essence reusable for all communication facilities, unlike physically printing identifying means on the cable or labels affixed on a temporary basis. Furthermore, to save on costs, connectors and pre-fabricated cables can be produced and purchased in bulk. Moreover, the embodiment of the system and device described herein may allow for installation, repair, removal, or servicing (or similar function) of more than one cable at a time, which may be beneficial for high density cabling areas. Thus embodiments of the method described herein that incorporate a reusable and removable device for establishing a correlation between a patch panel connection to a communication device may allow completion of certain tasks in a surprisingly time-efficient manner in comparison to some prior art methods.

Different embodiments of the system and device described herein may include a wide variety of types and shapes of female connectors, such as those that would reduce "snagging," that may "snap" onto a male connector, or that may relieve stress or pressure at the point where the male connector meets, thus allowing the male connector and cable to be held essentially immobile to excess movement. In one embodiment described herein, the female connector may comprise a front end, a back end, and a lateral portion connecting the front end and the back end. The front end may comprise some means of attaching to the end of a connection cable. The end of a connection cable may often comprise a male connector and such male connectors may be found on each opposite end of a connection cable. In its environment of use, one male connector on one end of a connection cable may connect to a port, and a male connector on the opposite end may connect to a node. In one of the embodiments described herein, the lateral portion of said female connector may comprise means of identifying the connection cable. More particular for some embodiments, the connection cable identification means may identify to which port the opposite end of the connection cable may be connected. Various means of identification may of course be utilized, including but not limited to different patterns of colors, symbols (and not all means of identification need be visibly distinguishable).

Different embodiments may be used for different types of connections, intended for different uses—stated differently, the eligible types of connections are not limited. The following are illustrative of different types of connections that may be compatible with embodiments of the system and device described herein, and are not intended to be limited in application: RJ45, RJ11, RJ12, DB15, mini-SAS, SFP+ SFF-8431, SFF-8436, SFF-8470, SFF-8087, CX4 Male, CX4 Female, Fiber, LC, SC, ST, MTP, MTRJ, HDMI, RCA, Coax, S-Video, component video, USB, 15 pin, LS. Thus, since the ends of various types of connections may vary, and may change depending on a prevailing industry standard, the attachment means of the female connector may also vary accordingly. In addition, some female connectors embodiments may be semi-universal and be adapted for attachment with more than one type of connection cable. Some embodiments of the attachment means may comprise an aperture on the front end adapted to receive and secure a male connector of the particular connection cable therein. Since some styles of male connectors of connection cables may comprise a clip portion to ensure that the male connector remains securely connected, the aperture of some female connector embodiments may accordingly comprise a recessed area adapted to releasably secure the clip portion in a locked position.

Other embodiments may consist of different materials and/or varying thickness, such as for example those more suited for restrictive areas such as high or low density locations or settings (whether in a communications closet utilizing 200 plus connections to a personal home network, etc.). Certain other embodiments may include a back end portion of a female connector shaped to allow stacking, bundling, and/or sorting, of other connectors on top of each other. In addition, an end of the female connector may either be closed or open, or any variation thereof (holes) etc., and may apply to different types of male connectors (e.g., LC to MTRJ on the other—meaning if there was a cable created that has a connector that is different on either end).

Once the identification means of the female connector have identified the connection cable, such as for example by identifying to the user to which port the opposite end of the connection cable is connected, in some embodiments the female connector may be removed to allow the male connector to connect to a node. Other embodiments may be designed to allow the male connector to connect to a node without previously removing the female connector (although in such instances the female connector may still be removed). Some embodiments of the female connector may be designed for reuse—that is, for attachment with other connection cables.

The above description and listed alternative embodiments are considered that of some embodiments only. It is understood that the embodiments shown in the drawings and described below are merely for illustrative purposes and not intended to limit scope. Alterations and modifications, therefore, and such further applications as would occur to those skilled in the relevant art(s), are also contemplated.

DETAILED DESCRIPTION OF THE PREFERRED EMBODIMENTS

A "female" connector is defined herein as having any shape and/or configuration capable of releasably interconnecting with the male end of a connection cable, and is not necessarily required to "cover" the male end. Similarly, "male connector" is herein defined as the end of a connection cable, regardless of any particular shape of that end (e.g., RJ45, etc.). "Connect" and "attach" are each defined herein to include at least both the definitions of each of those terms. "Connection cable" is herein defined to comprise all types of data transmitting connections, cables, wires, cords, etc. "Communication facility" is defined herein to include both high and low density communication environments, regardless of number of connection cables. "Node" is defined herein broadly to include, but not be limited to, any device to or from which data may be transmitted ("data" also being defined broadly to include but not be limited to any information and/or signals transmitted using voltage, whether high or low voltage).

Figure 1:
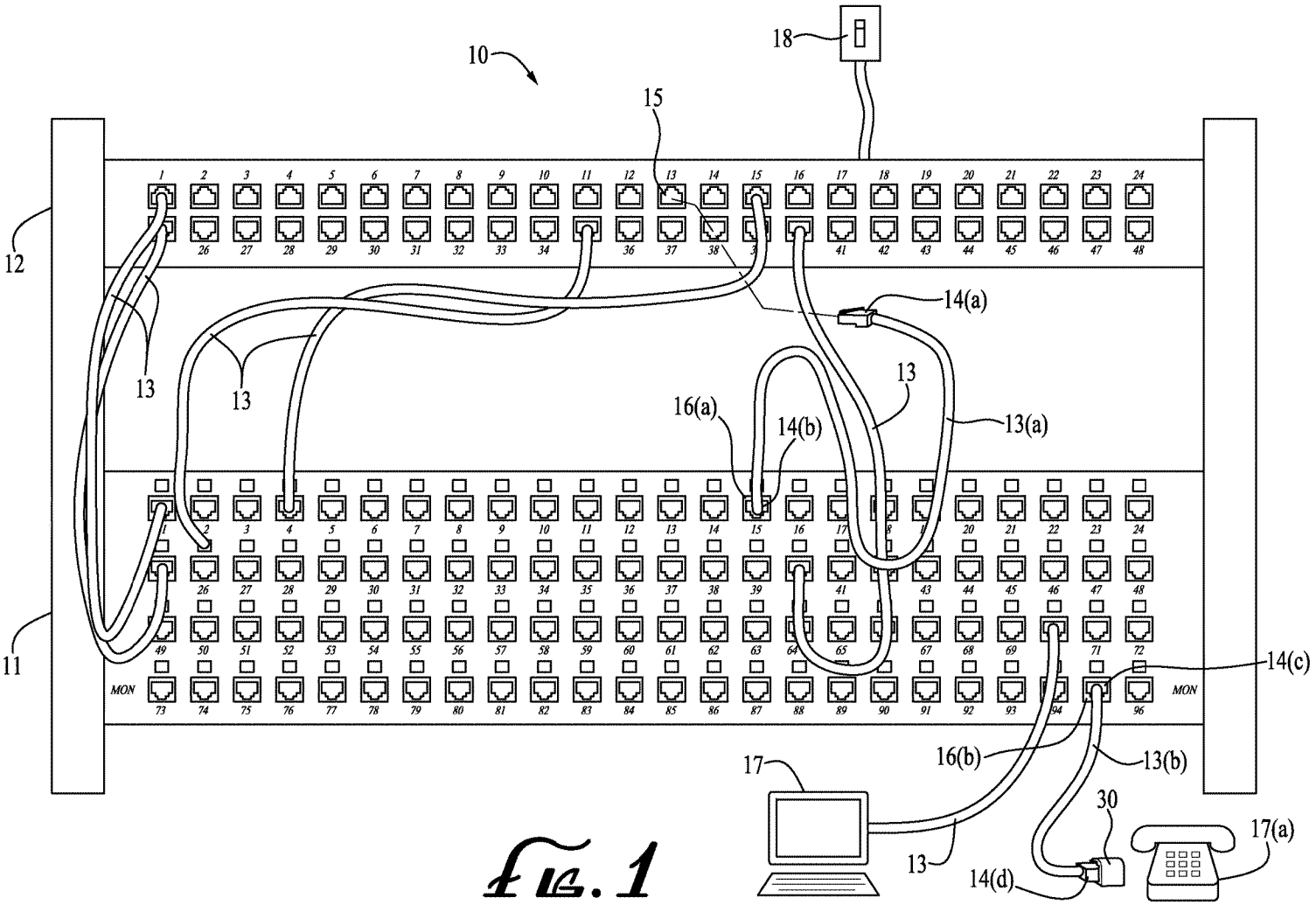
FIG. 1 is a front view of a communication facility and connection cables.

Referring to the drawings, FIG. 1 illustrates a communication facility or rack 10, (which might be typically located in, for example, communications/telecomm closets/etc.) into which a patch panel 11 and network/communication equipment 12 are installed. (Although the patch panel shown in FIG. 1 may be "copper" or non-fiber, it is anticipated that embodiments of the system and device described herein may also find application with other types of patch panels, such as fiber patch panels.) Connection cables 13 may be organized and/or aggregated by the patch panels 11.

A first male connector end 14(*a*) of one communication or connection cable 13(*a*) may be inserted into a communications port for a network/communication device 15, which may be located in the network equipment portion 12 of the communication facility or rack 10. A second male connector end 14(*b*) of the communication or connection cable 13(*a*) may be inserted into a first patch panel port 16(*a*), which may be located in the patch panel portion 11 of the communication facility or rack 10. A third male connector end 14(*c*) of a second communication or connection cable 13(*b*) may be inserted into a second patch panel port 16(*b*), and a fourth male connector end 14(*d*) of the second communication or connection cable 13(*b*) may be configured to connect with a particular node/communication device 17(*a*), such as a phone (the third male connector end 14(*c*) and the fourth male connector end 14(*d*) comprising opposites ends of the connection cable 13(*b*)). Thus, connection cables 13 may assist in forming a connection between "nodes" 17 (i.e. communication devices such as, for example, a television, computer, camera, printer, scanner, etc.), and an aggregate device 18 (whether passive or active), such as a switch, router, server, etc. (the aggregate device 18 being symbolized in FIG. 1 as a "switch" regardless of lack of actual physical resemblance to such a switch).

Figure 2:
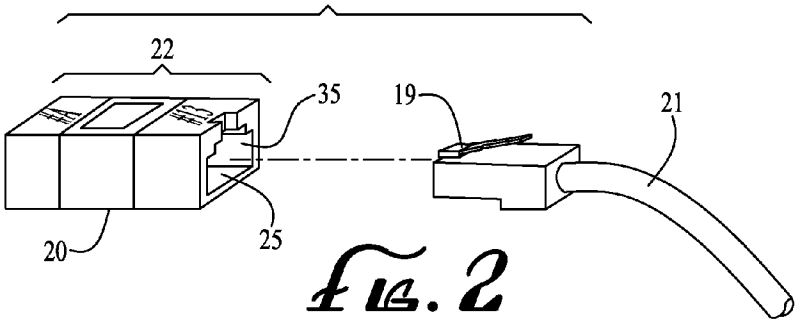
FIG. 2 is a side perspective view of a male end of a connection cable being inserted into a front end of one embodiment of a female connector identification device.
Figure 3:
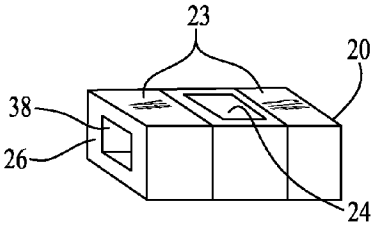
FIG. 3 is a side perspective view of the back end of the female connector identification device of FIG. 2.
Figure 5:
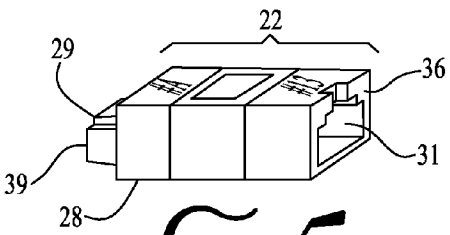
FIG. 5 is a side perspective view of the front end of another embodiment of a female connector identification device.
Figure 6:
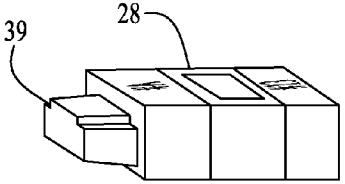
FIG. 6 is a side perspective view of the back end of the female connector identification device of FIG. 5.
Figure 8A:
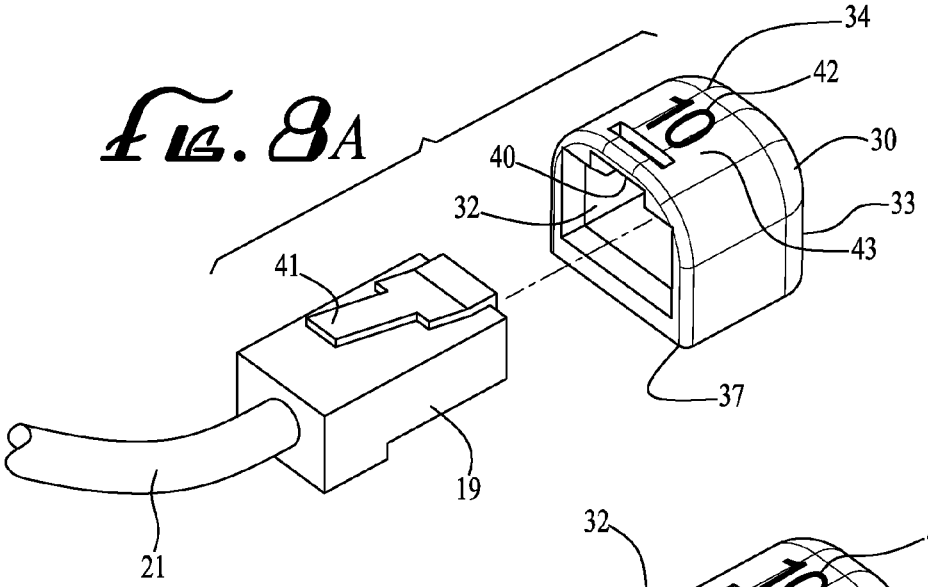
FIG. 8A shows a side perspective view of a male end of a connection cable being inserted into another embodiment of a female connector identification device.
Figure 8B:
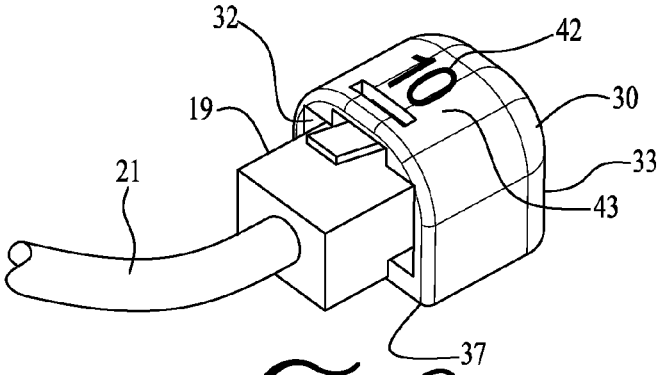
FIG. 8B shows a side perspective view of the female connector identification device of FIG. 8A attached to the male end of the connection cable of FIG. 8A.
Figure 9:
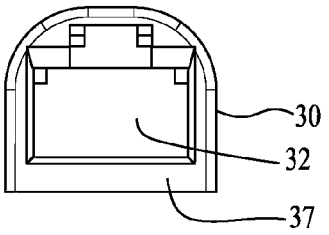
FIG. 9 shows a front view of the female connector end identification device of FIG. 8.

The relationship between a patch panel (such as the patch panel 11) and a node 17 creates a need for an identification device and/or system—for example (as shown in FIGS. 2, 3, 5, 6, 8A, 8B, and 9), one such identification device and/or system may involve using embodiments of a female connector 20, 28, 30 comprising features identifying the connection cables 13. Attaching/connecting such embodiments of a female connector 20, 28 (as shown in FIGS. 2, 3, 5, 6) 30 (as shown in FIGS. 8A, 8B and 9), to a male connector 19 on the end of a connection cable 21 (as shown in FIG. 2), or more specifically to the fourth male connector end 14(*d*) of the second communication or connection cable 13(*b*) (as shown in FIG. 1), may allow identification of the connection between the patch panel 11 and the communication devices 17 (the nodes) (such as the particular communication device, the phone 17(*a*)). Stated differently, embodiments of the system and device described herein may be used to identify the connection from the communication facility 10 to communication devices 17, once the connection cables 13 are (or a singular communication cable such as the second communication or connection cable 13(*b*), is) removed from the communication devices 17 (or particular device 17(*a*)). By way of further example, as shown in FIG. 2, embodiments of the system and device described herein may be used to identify the connection cable 21, using the female connector 20 that may attach to the male connector 19 end of the connection cable 21 (which in the embodiment shown may be a male RJ45 connector end).

To enable such identification, the female connector 20 may be distinguishable in some manner, such as, for example, by bearing visual markings 22. Examples of such markings may include alpha-numeric symbols 23 and/or color coding bands 24. In the particular embodiment shown, by inserting the male connector 19 of the connection cable 21 into a female connector 20 bearing such markings 22, the male connector 19 and connection cable 21 may be identified. Some embodiments of the female connectors 20, 28, 30 may include apertures 25, 31, 32 along its front end 35, 36, 37 into which the male connector 19 may be inserted. Nevertheless, the means for attaching the female connector embodiments 20, 28, 30 (and any variations thereof) to the connection cables 13, 21 (including variations of such connection cables), and to the male connector ends thereof 14(*a*), 14(*b*), 14(*c*), 14(*d*), 19 (including variations of such ends) are not intended to be limited in design, scope, or application, and may be adapted to any prevailing industry standard for connector ends (or to a non-prevailing industry standard). For example, the apertures 25, 31, 32 may vary in size and shape adapted to the size and of the male connector ends 14(*a*), 14(*b*), 14(*c*), 14(*d*), 19, and in some embodiments attaching may still occur for embodiments that do not comprise apertures at all.

Figure 7:
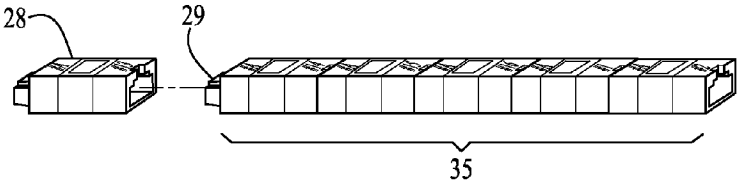
FIG. 7 illustrates a means for storing multiple female connector identification devices of FIG. 5.
Figure 4:
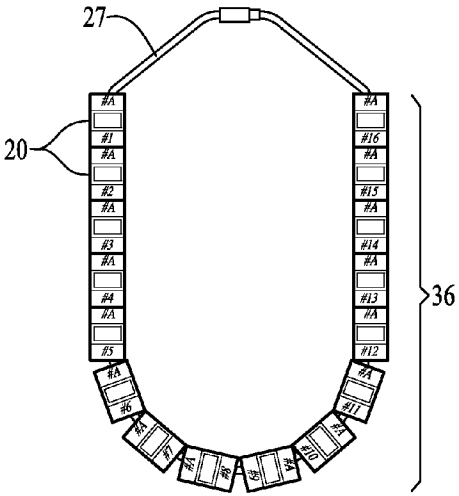
FIG. 4 illustrates a means for storing multiple female connector identification devices of FIG. 2 on a loop.

The back ends 26, 29, 33 of the female connectors 20, 28, 30 opposite from the front ends 35, 36, 37 comprising the apertures 25, 31, 32 for attaching/connecting, may also vary in design and function. For example, the female connector 20 shown in FIG. 2, in addition to the aperture 25 on its front end 35, may also include another back end aperture 38, which feature, as shown in FIG. 4, together with the front end 35 aperture 25, may allow for easier carrying and/or storage of a plurality of female connectors 20 together, for example, through insertion of a cord 27 or other device/means through both apertures 25, 38 of each of the plurality of such female connectors 36, possibly forming a loop. Other embodiments may have different designs, shapes, and styles, such as the embodiment of a female connector 28 shown in FIGS. 5 and 6, which may still comprise identifying means such as physical markings 22, but on the back end 29 opposite from the aperture 31 on the front end 36 into which the male connector 19 may be inserted, may be a piece shaped to replicate 39 to a substantial degree the shape of the male connector 19 or adapted to fit tightly within the aperture 31. In this manner, as shown in FIG. 7, the piece of the female connector 28 that replicates to a substantial degree the male connector 39 may be inserted into another female connector 28, and repeated with a plurality of female connectors 35, to allow for convenient storage and portability.

In addition, the shape of embodiments of the connector identification device may vary in shape according to stylistic preference as well as desired functionality. For example, as shown in FIGS. 8A, 8B, and 9, one female connector embodiment 30 may have some rounded or curved edges 34, which may assist to prevent snagging of the female connector 30 while tracing is being performed. In addition, the aperture 32 of the front end 37 of the female connector 30 may comprise a recessed area 40 adapted to releasably secure a clip portion 41 of the male connector 19 in a locked position. The particular location of connection cable identification means/distinguishing marks 42 along the female connector 30 may vary, but in the embodiment shown may be located along the exterior surface of a lateral part 43 in between the front end 37 and the back end 33 of the device 30. As shown in FIG. 8B, the female connector 30 may attach to the male connector 19 but need not cover completely said male connector 19.

I claim:

1. A device for identifying a connection cable among a plurality of uniquely identifiable connection cables of a communication facility, the connection cable having a first end and a second end with at least one of the first and second ends comprising a male connector, the male connector having a connection cable side contiguous with the connection cable, and a distal side opposite the connection cable side, the device comprising:

a female connector provided independent of the connection cable and comprising a first end and a second end, the first end comprising an opening to an internal cavity sized to receive a portion of the male connector therein and configured to releasably attach to the distal side of the male connector of the connection cable, the female connector including an exterior surface, a unitary construction, and at least one cable-identification feature that provides an indicator unique to the connection cable of the plurality of uniquely identifiable connection cables, wherein the at least one cable-identification feature comprises at least one visible distinguishing characteristic on the exterior surface of the female connector, and wherein the female connector is distinct from the communication facility and a port, wherein the cavity is sized to enclose less than all of the distal side of the male connector when the female connector is attached to the male connector, and wherein the second end is arranged opposite the first end.

2. The device of claim 1, wherein the visible distinguishing characteristic comprises an alphanumeric symbol.

3. The device of claim 1, wherein the visible distinguishing characteristic comprises color coding.

4. The device of claim 1, wherein the cavity comprises a first aperture for receiving the male connector.

5. The device of claim 4, wherein the female connector comprises a front end and a back end, and the first aperture comprises at least one tapered surface from the front end to the back end.

6. The device of claim 4, wherein the male connector comprises a clip for releasable attachment of the male connector to the female connector, and the first aperture comprises a recessed area adapted to receive the clip.

7. The device of claim 4, wherein the female connector further comprises a second aperture communicating with the first aperture, the first and second apertures being configured to receive a cord, wherein the cord is distinct from the cable.

8. The device of claim 4, wherein a back end of the female connector comprises a connecting feature for attaching to another female connector.

9. The device of claim 4, wherein the female connector comprises rounded edges to reduce snagging on other objects.

10. The device of claim 1, wherein the female connector comprises at least some rounded edges to reduce snagging on other objects.

11. The device of claim 1, wherein the female connector includes a female receiver and a male feature, the male feature extending opposite the female receiver and being configured to releasably attach to the communication facility.

12. A system for identifying a connection cable among a plurality of uniquely identifiable connection cables of a communication facility, the system comprising:

a plurality of ports;

a connection cable having a first end and a second end with at least one of the first and second ends comprising a male connector, the male connector having a connection cable side contiguous with the connection cable, and a distal side opposite the connection cable side; and a female connector provided independent of the connection cable and comprising a first end and a second end, the first end comprising an opening to an internal cavity sized to receive a portion of the male connector therein and configured to releasably attach to the distal side of the male connector of the connection cable and only attach to the male connector, the female connector providing at least one cable-identification feature unique to the connection cable of the plurality of uniquely identifiable connection cables, wherein the at least one cable-identification feature comprises at least one visible distinguishing characteristic on an exterior surface of the female connector, wherein the female connector is distinct from the communication facility and a port, and wherein the second end is arranged opposite the first end.

13. The system of claim 12 wherein the communication facility is selected from a group comprising a patch panel and communication equipment.

14. The system of claim 12 wherein the connection cable ends are selected from a group comprising RJ45, RJ11, RJ12, DB15, mini-SAS, SFP+SFF-8431, SFF-8436, SFF-8470, SFF-8087, CX4 Male, CX4 Female, Fiber, LC, SC, ST, MTP, MTRJ, HDMI, RCA, Coax, S-Video, component video, USB, 15 pin, and LS.

15. The system of claim 12 wherein the cable-identification feature comprises at least one alphanumeric symbol.

16. A method for identifying a particular connection cable connecting a node to a communication facility, the method comprising:

selecting the particular connection cable from among a group of connection cables;

connecting a first end of the particular connection cable to a port of the communication facility;

providing a female connector independent of the particular connection cable, the female connector providing an indicator unique to the particular connection cable;

releasably attaching the female connector to a distal side of a male connector of a second end of the particular connection cable, wherein the distal side of the male connector is opposite a connection cable side of the male connector contiguous with the particular connection cable and is insertable into a port of the node;

optionally detaching the female connector from the second end of the particular connection cable for reuse; and connecting the second end of the particular connection cable to the node;

wherein the female connector is distinct from the communication facility and a port.

17. The method of claim 16, wherein the female connector comprises an aperture for receiving the male connector therein.

18. The method of claim 16, wherein the indicator comprises at least one alphanumeric symbol, and the method further comprises identifying the connection cable using the at least one alphanumeric symbol.

19. The method of claim 16, wherein the female connector is configured to distinguish between the first end of the connection cable and the second end of the connection cable.

20. A device for identifying a connection cable of a communication facility, the communication facility comprising a patch panel and network/communication equipment, the patch panel and network/communication equipment each comprising a plurality of ports, the connection cable comprising a first end and a second end, the first end comprising a first male connector, and the second end comprising a second male connector, the first and second male connectors each having a connection cable side contiguous with the connection cable, and a distal side opposite the connection cable side and being insertable into the ports for connecting the network/communication equipment to the patch panel, and for connecting the patch panel to a node, the device comprising:

a female connector comprising a first end and a second end, the first end comprising an opening to an internal cavity sized to receive a portion of the male connector therein, the first connector for releasably attaching to the distal side of the one of the first and second male connectors, and only attach to the male connector, the female connector comprising a front end and a back end, and a lateral part connecting the front end and the back end, the front end comprising a male connector receiver, the lateral part comprising at least one connection cable-identification feature of a plurality of optional cable identification features, wherein the at least one cable-identification feature comprises at least one visible distinguishing characteristic on an exterior surface of the female connector;

wherein the male connector receiver is connected to one of the first and second male connectors, and the connection cable identification feature provides a unique identifier for the connection cable, and wherein the female connector is distinct from the communication facility and a port, and wherein the second end is arranged opposite the first end.

21. The device of claim 20, wherein the connection cable identifying feature comprises an alphanumeric symbol.

22. The device of claim 20, wherein the male connector receiver comprises an aperture for receiving the one of the first and second male connectors.

* * * * *